US010047643B2

(12) United States Patent
Urushihata

(10) Patent No.: US 10,047,643 B2
(45) Date of Patent: Aug. 14, 2018

(54) VARIABLE VALVE TIMING CONTROL APPARATUS FOR ENGINE

(75) Inventor: Haruyuki Urushihata, Chiryu (JP)

(73) Assignee: DENSO CORPORATION, Kariya (JP)

( * ) Notice: Subject to any disclaimer, the term of this patent is extended or adjusted under 35 U.S.C. 154(b) by 1257 days.

(21) Appl. No.: 13/210,771

(22) Filed: Aug. 16, 2011

(65) Prior Publication Data

US 2012/0073531 A1 Mar. 29, 2012

(30) Foreign Application Priority Data

Sep. 28, 2010 (JP) ..... 2010-216390

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2001/34463* (2013.01)

(58) Field of Classification Search
USPC ..... 123/90.15, 90.17; 701/105
See application file for complete search history.

(56) References Cited

U.S. PATENT DOCUMENTS 5,738,056 A 4/1998 Mikame et al.
6,330,870 B1 * 12/2001 Inoue et al. ..... 123/90.17
6,889,634 B1 * 5/2005 Roth ..... 123/41.44
2003/0000489 A1 * 1/2003 Majima et al. ..... 123/90.17
2007/0204817 A1 * 9/2007 Russell et al. ..... 123/90.12
2010/0139592 A1 6/2010 Takemura

FOREIGN PATENT DOCUMENTS

JP 2000-345815 12/2000
JP 2004-263609 9/2004

OTHER PUBLICATIONS

Office Action (2 pages) dated Jan. 31, 2013 issued in corresponding Japanese Application No. 2010-216390 and English translation (3 pages).

* cited by examiner

*Primary Examiner* — Jorge Leon, Jr.
(74) *Attorney, Agent, or Firm* — Nixon & Vanderhye P.C.

(57) ABSTRACT

When a variable valve timing device controls an oil pressure control valve in a manner that a VCT phase is locked at a middle lock phase, an advance chamber and a retard chamber are made to communicate with each other, so that oil is filled into both of the advance chamber and the retard chamber when the oil pressure control valve supplies oil to one of the advance chamber and the retard chamber in an oil filling mode. An oil pump supplies oil to the oil pressure control valve, and is controlled to have an oil flow rate that is equal to or larger than a predetermined value in the oil filling mode.

12 Claims, 9 Drawing Sheets

VARIABLE VALVE TIMING CONTROL APPARATUS FOR ENGINE

CROSS REFERENCE TO RELATED APPLICATION

This application is based on Japanese Patent Application No. 2010-216390 filed on Sep. 28, 2010, the disclosure of which is incorporated herein by reference in its entirety.

BACKGROUND OF THE INVENTION

1. Field of the Invention

The present invention relates to a variable valve timing control apparatus for an internal combustion engine.

2. Description of Related Art

JP-A-9-324613 (U.S. Pat. No. 5,738,056) or JP-A-2001-159330 (U.S. Pat. No. 6,330,870) describes an oil-pressure drive type variable valve timing device for an engine, in which a rotation phase of a camshaft with respect to a crankshaft is locked into a middle lock phase when the engine is stopped. The rotation phase of the camshaft with respect to the crankshaft is defined as variable cam timing (VCT) phase. The middle lock phase is located approximately middle in a controllable range of the VCT phase. A controllable range of the valve timing is enlarged by setting the middle lock phase.

The middle lock phase is set suitably for start-up of the engine. The engine is activated in a state where the VCT phase is locked into the middle lock phase. When the start-up of the engine is completed, an oil pressure is raised to an appropriate value by speed-up of the engine (increase in rotation of oil pump). Then, oil is filled into the timing device, and the VCT phase is unlocked and controlled into a target VCT phase in accordance with an operation state of the engine.

Because the VCT phase is locked at the middle lock phase while the engine is stopped, after the engine is restarted, it is necessary to quickly fill oil into both of an advance chamber and a retard chamber. A communication passage is defined to connect the advance chamber to the retard chamber while the VCT phase is locked, and oil supplied to the advance chamber is further supplied to the retard chamber through the communication passage. Further, an oil supply passage of the retard chamber is connected to a drain passage, and air in the retard chamber is discharged into the drain passage. Thus, oil can be easily and accurately filled into the chambers.

However, a part of oil filled into the retard chamber may be directly discharged into the drain passage. In this case, oil is consumed in vain, and lubricating oil may be shorted for the engine while oil is filled into the chambers, so that lubricating property of the engine may become worse.

SUMMARY OF THE INVENTION

According to an example of the present invention, a variable valve timing control apparatus includes a variable valve timing device, a lock pin, an oil pressure control valve, an oil pump and an oil securing portion. The variable valve timing device controls valve timing by changing a rotation phase of a camshaft with respect to a crankshaft in an engine. The rotation phase of the camshaft with respect to the crankshaft is defined as a VCT phase. The lock pin locks the VCT phase at a middle lock phase positioned at a middle in a controllable range of the VCT phase. The oil pressure control valve controls pressure of oil supplied to an advance chamber that drives the VCT phase into an advance side, a retard chamber that drives the VCT phase into a retard side, and a lock chamber that drives the lock pin. The oil pump supplies engine-lubricating oil to the oil pressure control valve. The oil securing portion executes an oil securing control. The advance chamber and the retard chamber communicate with each other, when the variable valve timing device controls the oil pressure control valve in a manner that the VCT phase is locked at the middle lock phase by projecting the lock pin. The oil pressure control valve supplies oil to one of the advance chamber and the retard chamber that communicate with each other in an oil filling mode so as to fill both of the advance chamber and the retard chamber with oil. The oil securing portion executes the oil securing control in which the oil pump is controlled to have an oil flow rate that is equal to or larger than a predetermined value when the oil pressure control valve has the oil filling mode.

The oil securing control may be performed in the oil filling mode even when the oil pressure control valve normally works. The oil filling mode is relatively short, so that a possibility is low that the engine seizes up due to shortage in lubricating oil while the oil pressure control valve normally works. However, if the oil pressure control valve cannot recover from the oil filling mode by abnormality, the engine may seize up due to the shortage in lubricating oil, so that the oil securing control may be set to be performed only when the oil pressure control valve cannot recover from the oil filling mode by abnormality.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
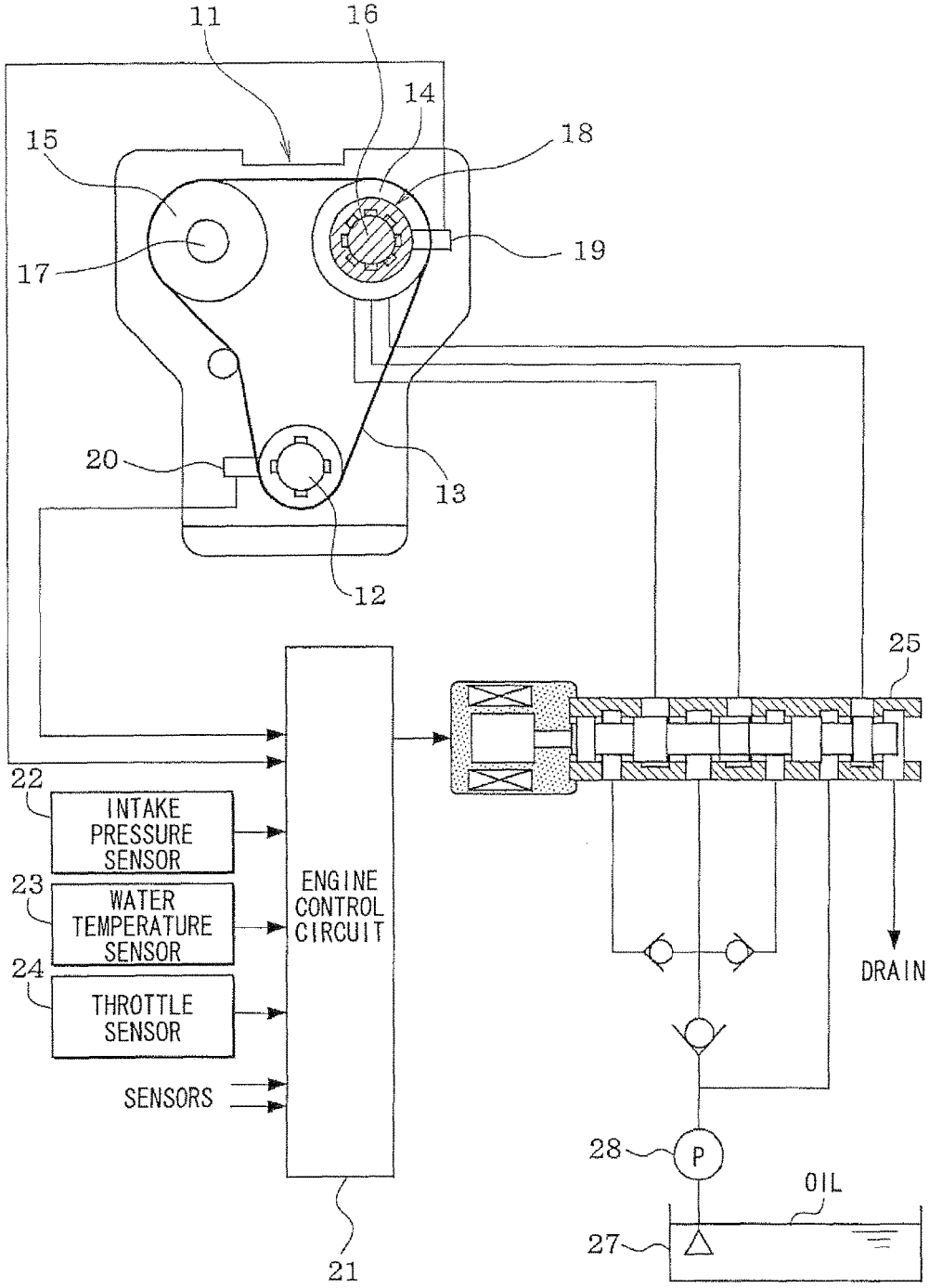
FIG. 1 is a schematic view illustrating an engine control system according to a first embodiment.

A first embodiment will be described with reference to FIGS. 1-7. As shown in FIG. 1, power is transmitted from a crankshaft 12 to an intake-side camshaft 16 and an exhaust-side camshaft 17 through respective sprocket 14, 15 by a timing chain 13, in an engine 11. The intake-side camshaft 16 has a variable valve timing device 18 to control an advance amount of the intake-side camshaft 16 with respect to the crankshaft 12, which is referred as variable cam timing (VCT) phase.

A cam sensor 19 is arranged on an outer circumference side of the intake-side camshaft 16, and outputs a pulse of cam angle signal by every predetermined cam angle for distinguishing cylinders from each other. A crank sensor 20 is arranged on an outer circumference side of the crankshaft 12, and outputs a pulse of crank angle signal by every predetermined crank angle. Signals output from the sensors 19, 20 are input into an engine control circuit 21.

The engine control circuit 21 calculates an actual valve timing (actual VCT phase) of an intake valve (not shown). Further, the circuit 21 calculates an engine rotation speed based on a frequency (interval) of the pulse output from the crank sensor 20. Other signals are input into the circuit 21 from sensors to detect engine operation state, such as intake pressure sensor 22, water temperature sensor 23 or throttle sensor 24.

The engine control circuit 21 controls fuel injection and ignition according to the engine operation condition detected by the sensors, and performs a variable valve timing control (phase feedback control). The circuit 21 performs a feedback control of oil pressure to drive the variable valve timing device 18 in a manner that an actual valve timing (VCT phase) of the intake valve coincides with a target valve timing (target phase).

The variable valve timing device 18 will be explained with reference to FIGS. 2 and 3. The sprocket 14 is rotatably supported by an outer periphery of the intake-side camshaft 16, and a housing 31 of the variable valve timing device 18 is tightened and fixed to the sprocket 14 with a bolt 32. Thereby, rotation of the crankshaft 12 is transmitted to the sprocket 14 and the housing 31 through the timing chain 13, so that the sprocket 14 and the housing 31 rotate in synchronization with the crankshaft 12.

A rotor 35 is tightened and fixed to one end of the intake-side camshaft 16 with a bolt 37. The rotor 35 is accommodated in the housing 31, and is rotatable relative to the housing 31.

Figure 3:
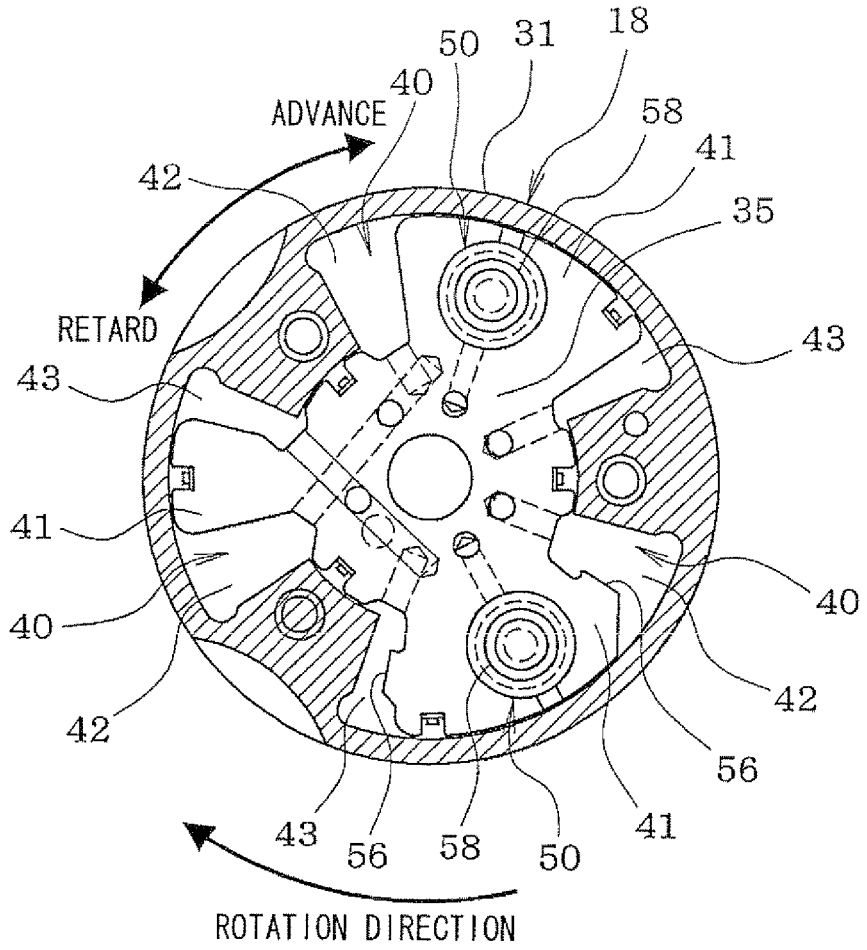
FIG. 3 is a schematic cross-sectional view illustrating the variable valve timing device.

As shown in FIG. 3, plural vane-accommodating chambers 40 are defined inside of the housing 31. The chamber 40 is divided into an advance chamber 42 and a retard chamber 43 by a vane 41 defined on an outer periphery of the rotor 35. A stopper 56 is defined on both sides of at least one vane 41, and restricts a relative rotation of the rotor 35 (vane 41) with respect to the housing 31. Due to the stopper 56, an actual VCT phase is controllable between most retard phase and most advance phase.

The variable valve timing device 18 has a middle lock mechanism 50 which locks the VCT phase at a middle lock phase located between the most retard phase and the most advance phase. For example, the middle lock phase is located approximately middle between the most retard phase and the most advance phase.

Figure 2:
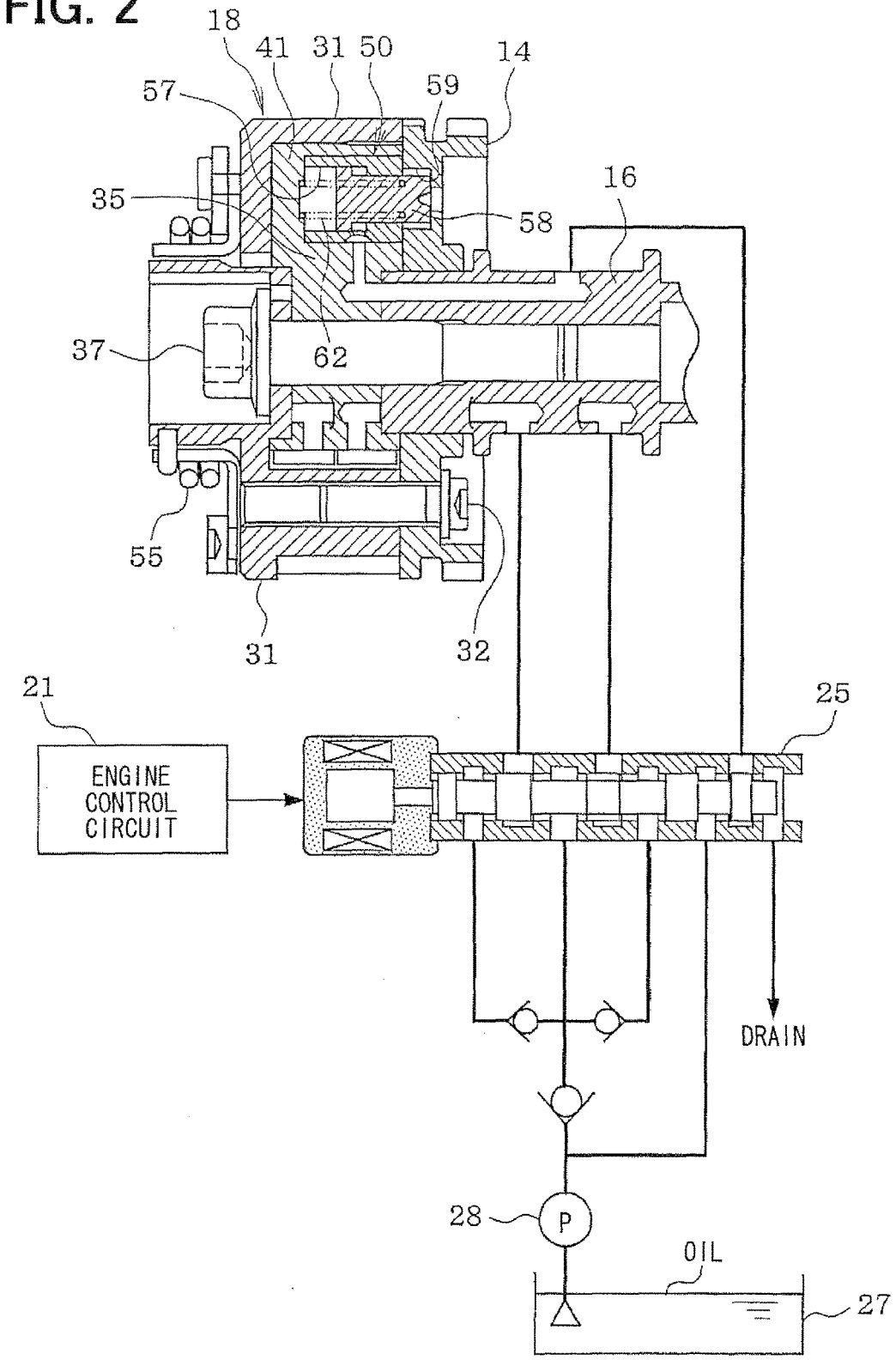
FIG. 2 is a schematic view illustrating a variable valve timing device and an oil pressure control circuit of the engine control system.

As shown in FIG. 2, a hole 57 is defined in the vane 41, and a lock pin 58 is accommodated in the hole 57 so as to be projectable from the hole 57. The lock pin 58 locks relative rotation between the housing 31 and the rotor 35 (vane 41).

Figure 4A:
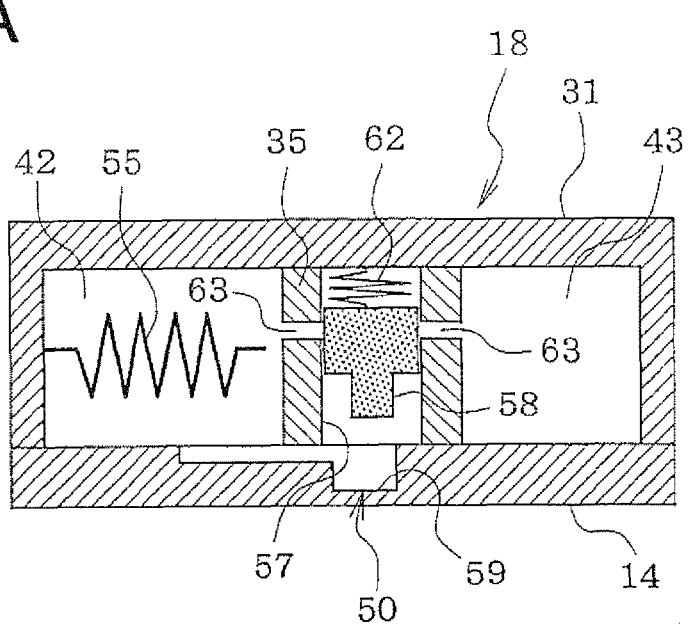
FIG. 4A is an explanatory view illustrating an unlock state in which an advance chamber and a retard chamber are disconnected from each other.
Figure 4B:
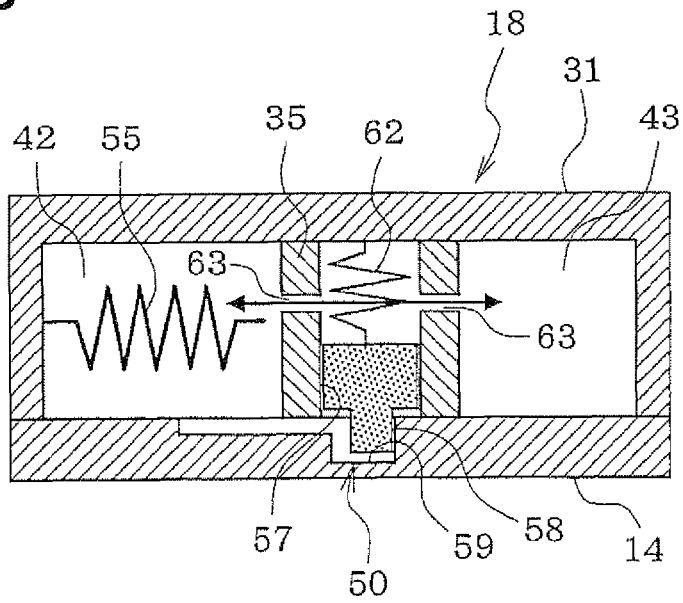
FIG. 4B is an explanatory view illustrating a lock state in which an advance chamber and a retard chamber are connected with each other.

As shown in FIG. 4B, while the lock pin 58 is fitted to a lock hole 59 defined in the sprocket 14, the lock pin 58 protrudes toward the sprocket 14. Thus, the VCT phase is locked at the middle lock phase located approximately middle in the controllable range. The middle lock phase is set suitably for start-up of the engine 11. The lock hole 59 may be defined in the housing 31, alternatively.

The lock pin 58 is biased into a lock direction (projection direction) by a spring 62. An unlock chamber is defined between an outer periphery of the lock pin 58 and the hole 57, and controls an oil pressure which drives the lock pin 58 into an unlock direction.

A spring 55 such as torsion coil spring is provided in the housing 31. A force of the spring 55 supports and assists oil pressure that relatively rotates the rotor 35 in an advance direction. In the timing device 18 of the intake valve, a torque of the intake-side camshaft 16 is applied so as to retard the VCT phase, so that the spring 55 biases the VCT phase into the advance direction that is opposite from the torque direction of the intake-side camshaft 16.

The force of the spring 55 is set to be applied in a range from the most retard phase to immediately before the middle lock phase. A fail-safe is considered when the engine is restarted after the engine is stopped by abnormality such as engine stall. If the engine is started with actual VCT phase located on the retard side from the middle lock phase in a state that the lock pin 58 is separated from the hole 57, the actual phase is advanced from the retard side to the middle lock phase due to the force of the spring 55 during a cranking of a starter (not shown). Thus, the VCT phase is locked by fitting the lock pin 58 into the hole 57.

In contrast, if the engine is started with actual VCT phase located on the advance side from the middle lock phase, a torque of the intake-side camshaft 16 is applied in the retard direction during the cranking. Therefore, the actual phase is retarded from the advance side to the middle lock phase due to the torque of the intake-side camshaft 16. Thus, the VCT phase is locked by fitting the lock pin 58 into the hole 57.

As shown in FIG. 4A, the rotor 35 has a communication passage 63 through which the advance chamber 42 and the retard chamber 43 communicate with each other. When the lock pin 58 is separated from the hole 59 so as to unlock the phase, the chambers 42, 43 are disconnected from each other by the lock pin 58. In contrast, as shown in FIG. 4B, when the lock pin 58 is fitted with the hole 59 so as to lock the phase, oil is able to flow between the chambers 42, 43 through the passage 63.

An oil pressure control valve 25 (OCV) of FIG. 2 controls the VCT phase of the timing device 18 and the lock pin 58 by controlling oil pressure. The OCV 25 integrally controls an oil pressure that drives the VCT phase and an oil pressure that drives the lock pin 58. That is, the OCV 25 controls both of the phase and the lock.

An oil pump 28 of FIG. 2, is driven by the engine 11, and working oil is pumped and supplied by the pump 28 from an oil pan 27 to the OCV 25. The OCV 25 may be 8-port and 4-position type spool valve, for example.

Figure 5:
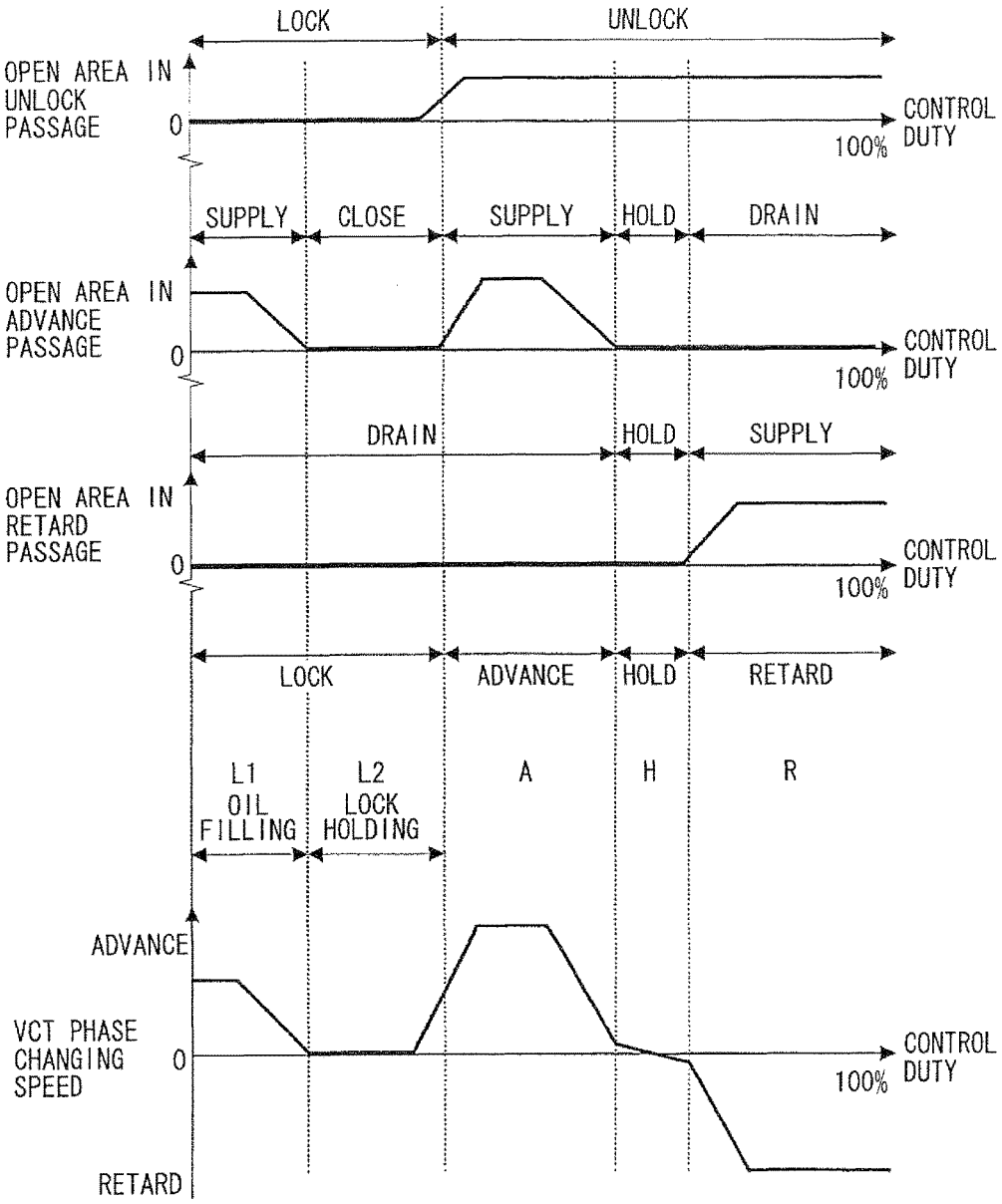
FIG. 5 is a view illustrating control characteristics of the variable valve timing device.

As shown in FIG. 5, a control status of the OCV 25 is separated into lock mode L1, L2, advance mode A, hold mode H and retard mode R, in accordance with a control duty of the OCV 25.

In the lock mode L1, L2, an oil supply passage that extends to the unlock chamber defined in the hole 57 is shut, so that oil pressure in the unlock chamber is lowered. Thus, as shown in FIG. 4B, the lock pin 58 is projected in the lock direction by the spring 62.

The lock mode has an oil filling mode L1 and a lock holding mode L2. In the oil filling mode L1, the pin 58 is projected, and an oil supply passage extending to the advance chamber 42 is opened, so that oil is supplied to the advance chamber 42. Further, oil is supplied to the retard chamber 43 through the communication passage 63 from the advance chamber 42.

In the lock holding mode L2, the pin 58 is projected, and the oil supply passage extending to the advance chamber 42 is shut.

In the lock mode L1, L2, the retard chamber 43 is connected to a drain passage. Therefore, in the oil filling mode L1, air in the chamber 42, 43 is discharged into the drain passage, so that oil filling property can be made better.

In the advance mode A, an oil supply passage extending to the retard chamber 43 is shut and connected to the drain passage, so that oil pressure in the retard chamber 43 is lowered. In this state, the oil supply passage extending to the advance chamber 42 is opened in accordance with control duty of the OCV 25. Thus, oil is supplied to the advance chamber 42, and the oil pressure in the advance chamber 42 is changed, so that the actual VCT phase is advanced.

In the hold mode H, the oil supply passage extending to the advance chamber 42 and the oil supply passage extending to the retard chamber 43 are shut, so that the oil pressure in the chamber 42, 43 is maintained. Thus, the actual VCT phase is maintained.

In the retard mode R, the oil supply passage extending to the advance chamber 42 is shut and connected to the drain passage, so that the oil pressure in the advance chamber 42 is lowered. In this state, the oil supply passage extending to the retard chamber 43 is opened in accordance with control duty of the OCV 25. Thus, oil is supplied to the retard chamber 43, and the oil pressure in the retard chamber 43 is changed, so that the actual VCT phase is retarded.

In the modes A, H, R other than the lock mode L1, L2, an oil supply passage extending to the unlock chamber defined in the hole 57 is opened, and oil is filled into the unlock chamber, so that oil pressure in the unlock chamber is raised. Therefore, the lock pin 58 is retreated from the lock hole 59, as shown in FIG. 4A, thereby unlocking the VCT phase.

In the oil filling mode L1, the advance chamber 42 and the retard chamber 43 are connected with each other through the communication passage 63. Oil is supplied to the advance chamber 42, and the retard chamber 43 is connected to the drain passage. In this case, a part of oil filled into the retard chamber 43 is discharged into the drain passage in vain, so that oil for lubricating the engine 11 may be shorted. If the OCV 25 continuously has the oil filling mode L1 by abnormality, the oil shortage continues for a long time. In this case, the engine 11 may seize up.

Figure 6:
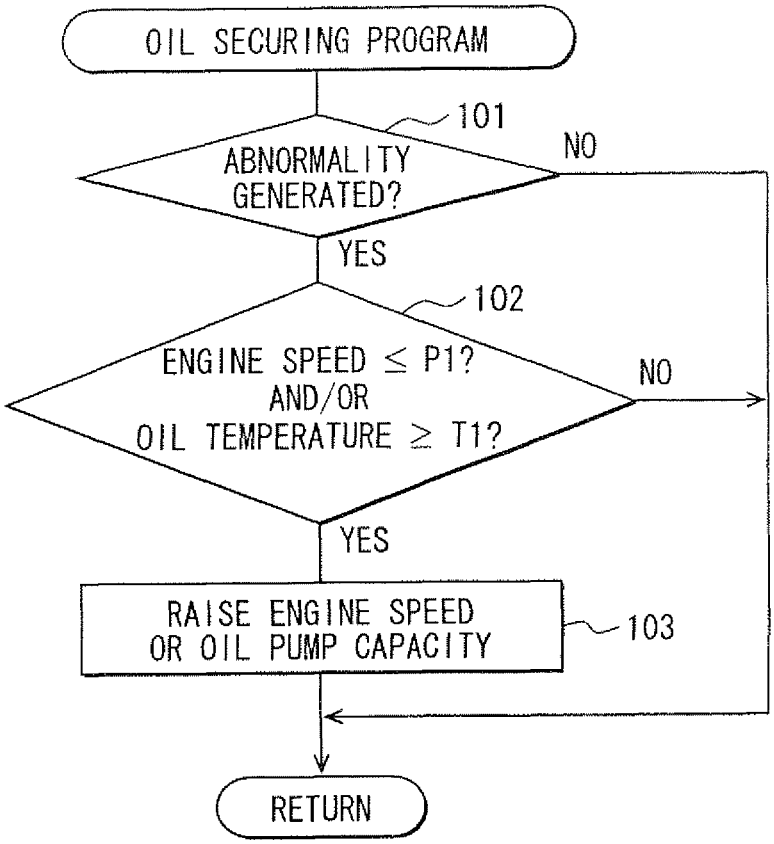
FIG. 6 is a flow chart illustrating an oil securing program.

According to the first embodiment, the engine control circuit 21 executes an oil securing program of FIG. 6. Specifically, when abnormality is generated in the OCV 25, that is when the oil filling mode is continued, an amount of oil discharged from the pump 28 is set to be equal to or larger than a predetermined amount so as to secure an oil amount necessary for lubricating the engine 11.

When the OCV 25 is sticking to the oil filling mode or when a signal that drives the OCV 25 is fixed to the oil filling mode, the oil filling mode is determined to be continued by abnormality.

Alternatively, in a case where the OCV 25 is set to have the oil filling mode when electricity supply is stopped, if electricity supply to the OCV 25 becomes impossible by a break in a line, the oil filling mode is determined to be continued by abnormality.

The amount of oil discharged from the pump 28 is increased by raising a rotation speed of the engine that drives the oil pump 28.

Alternatively, in a case where the oil pump 28 has a variable capacity, the capacity of the pump 28 may be increased while the oil securing control is performed.

When the engine speed is high, the amount of oil pumped by the pump 28 is increased, so that a predetermined oil amount is secured even if the oil securing control is not performed. Further, when a temperature of oil is low, oil leakage is reduced by high viscosity of oil, so that a predetermined oil amount is secured even if the oil securing control is not performed.

Therefore, the oil securing control is performed only when the engine speed is equal to or lower than a predetermined value and/or when the temperature of oil is equal to or higher than a predetermined value while the OCV 25 continues to have the oil filling mode by abnormality.

Figure 7:
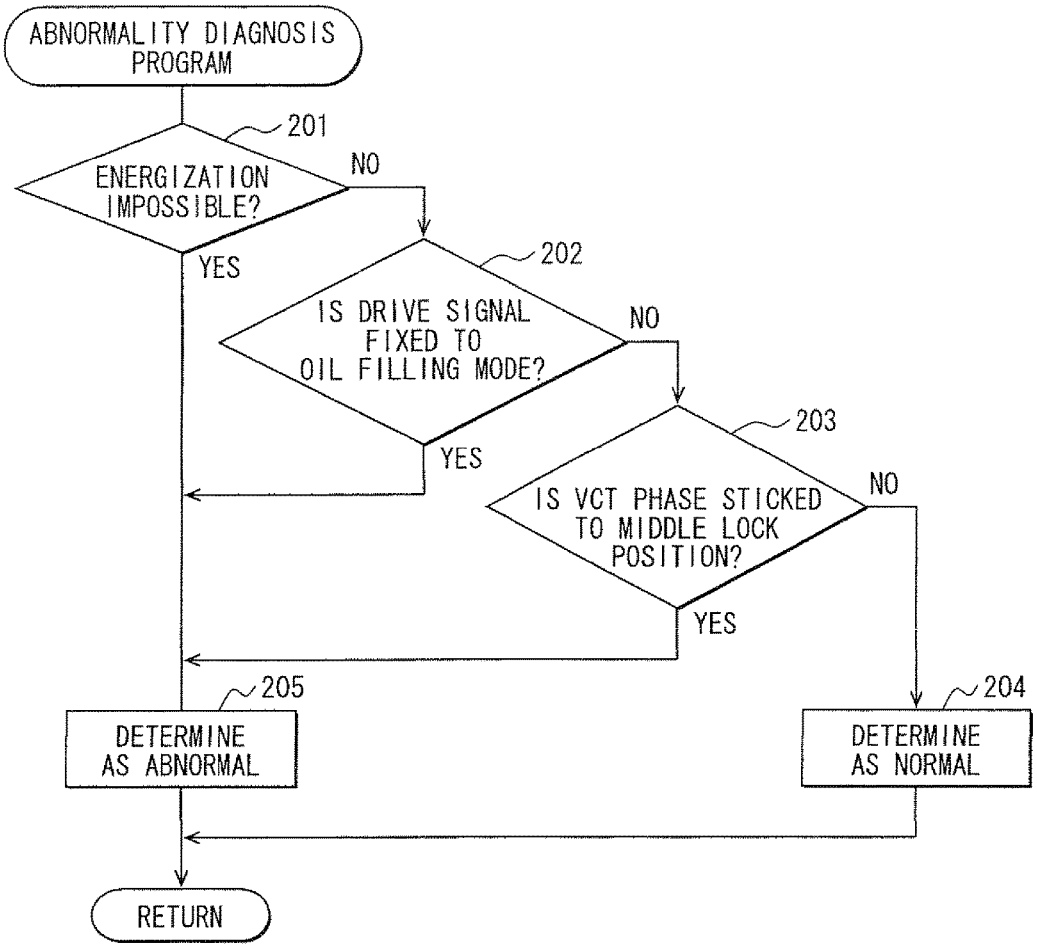
FIG. 7 is a flow chart illustrating an abnormality diagnosis program.

The oil securing control is performed by the circuit 21 based on programs of FIGS. 6 and 7.

An oil securing program of FIG. 6 is repeated by the circuit 21 with a predetermined cycle while the engine is active, and may correspond to an oil securing portion.

When the program of FIG. 6 is activated, it is determined whether abnormality is generated at step 101. Specifically, it is determined whether the OCV 25 is unable to be changed from the oil filling mode based on a result of abnormality diagnosis program of FIG. 7. If it is determined that abnormality is not generated, the program of FIG. 6 is ended.

If it is determined that abnormality is generated at step 101, it is determined whether the engine speed is equal to or slower than a predetermined value P1 and/or whether the temperature of oil is equal to or higher than a predetermined value T1, at step 102. Alternatively, it may be determined only whether the engine speed is equal to or slower than the predetermined value P1 at step 102, or it may be determined only whether the temperature of oil is equal to or higher than the predetermined value T1 at step 102.

The temperature of oil may be detected by a temperature sensor, or estimated by cooling water temperature detected by a cooling water temperature sensor. Alternatively, the temperature of oil may be estimated by drive history or oil temperature in an automatic shift. The temperature of oil may be estimated by a combination of the above methods.

If step 102 is determined as No, the program of FIG. 6 is ended without performing the oil securing control because the amount of engine-lubricating oil is determined as enough.

If step 102 is determined as Yes, step 103 is performed because the amount of engine-lubricating oil is determined as insufficient. At step 103, a speed of the engine that drives the pump 28 is raised so as to secure the lubricating oil amount. Alternatively, the capacity of the pump 28 is raised so as to secure the lubricating oil amount, when the oil pump 28 has a variable capacity.

Step 102 may be omitted. That is, when the OCV 25 continues to have the oil filling mode by abnormality, the engine speed or the capacity of the pump 28 is raised at step 103 regardless of the engine speed or the oil temperature.

An abnormality diagnosis program of FIG. 7 is repeated by the circuit 21 with a predetermined cycle while the engine is active. When the program of FIG. 7 is activated, it is determined whether energization of the OCV 25 is impossible by a break in line at step 201. If the energization of the OCV 25 is determined as impossible, it is determined that the OCV 25 has abnormality at step 205. Specifically, it is determined that the OCV 25 cannot recover from the oil filling mode at step 205.

If it is determined that the energization of the OCV 25 is possible at step 201, it is determined whether a signal that drives the OCV 25 is fixed to the oil filling mode at step 202. For example, the drive signal of the OCV 25 is determined as one that enables the OCV 25 to recover from the oil filling mode or not. If it is determined that the drive signal of the OCV 25 is fixed to the oil filling mode at step 202, it is determined that the OCV 25 has abnormality at step 205. That is, the OCV 25 cannot recover from the oil filling mode.

If it is determined that the drive signal of the OCV 25 is not fixed to the oil filling mode at step 202, it is determined whether the VCT phase is sticking to the middle lock phase at step 203. For example, it is determined whether the VCT phase is able to be unlocked by temporarily performing an unlock control. That is, it is determined whether the VCT phase is able to be changed from the middle lock phase.

If it is determined that the VCT phase is fixed to the middle lock phase at step 203, it is determined that the OCV 25 has abnormality at step 205. The OCV 25 cannot recover from the oil filling mode, because the VCT phase cannot be changed from the middle lock phase.

If all the determination results of step 201-203 are "No", it is determined that the OCV 25 is normal at step 204. One or two of step 201-203 may be omitted.

According to the first embodiment, when abnormality is generated, that is when the OCV 25 cannot recover from the oil filling mode, a flow rate of oil pumped by the oil pump 28 is controlled to become equal to or higher than a predetermined value. Therefore, a predetermined amount of lubricating oil can be secured, so that lubricating property of the engine 11 can be secured. Thus, the engine 11 can be restricted from seizing up.

Second Embodiment

Figure 8:
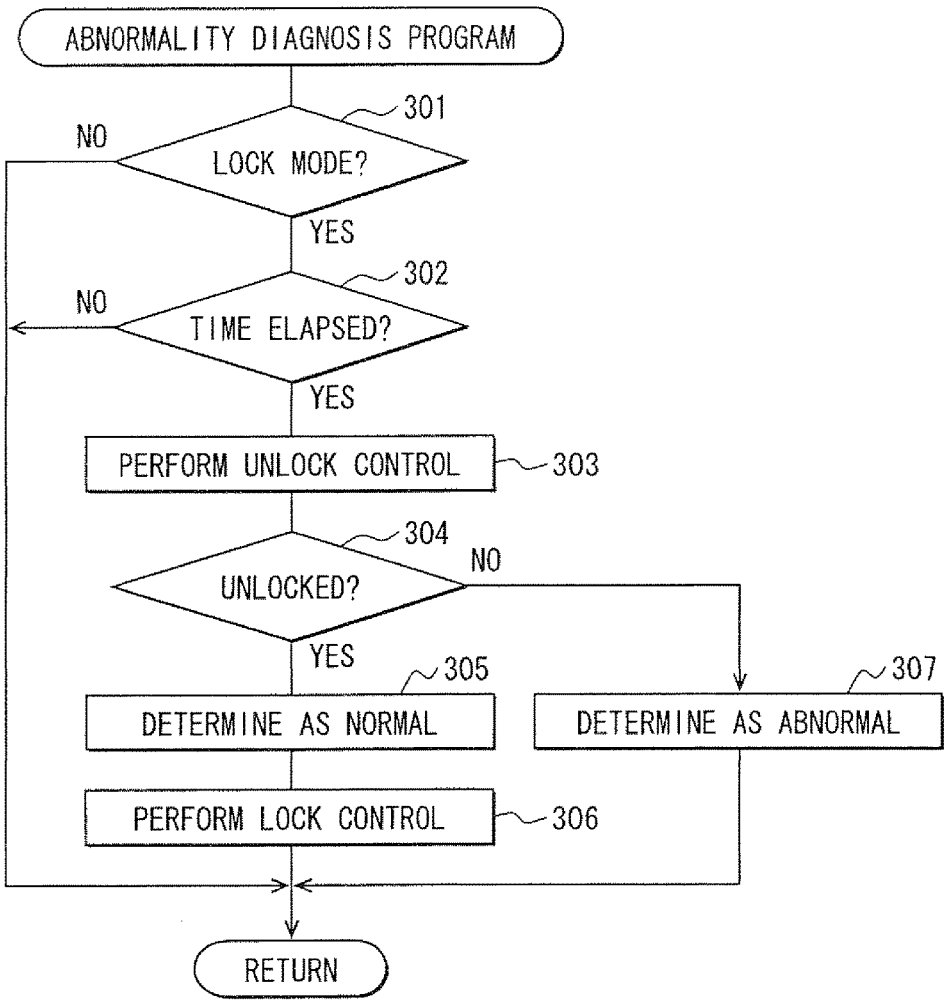
FIG. 8 is a flow chart illustrating an abnormality diagnosis program according to a second embodiment.

In a second embodiment, an abnormality diagnosis program of FIG. 8 is repeated by an engine control circuit 21 with a predetermined cycle. A control to temporarily unlock the VCT phase is performed every time when a predetermined duration is continued in a state the VCT phase is locked at the middle lock phase. If the VCT phase is unable to be unlocked, it is determined that the OCV 25 cannot recover from the oil filling mode by abnormality.

In FIG. 8, it is determined whether the control status is in the lock mode at step 301, in which the VCT phase is locked into the middle lock phase. If a determination result of step 301 is No, the program of FIG. 8 is ended. If the determination result of step 301 is Yes, it is determined whether the lock mode continues for a predetermined duration at step 302. If a determination result of step 302 is No, the program of FIG. 8 is ended.

When the lock mode is continued for the predetermined duration at step 302, the unlock control is temporarily performed at step 303. Then, at step 304, it is determined whether the VCT phase is unlocked so as to be changed from the middle lock phase in real. If it is determined that the VCT phase is unable to be unlocked, it is determined that the OCV 25 cannot recover from the oil filling mode by abnormality at step 307.

If it is determined that the VCT phase can be unlocked at step 304, the OCV 25 is determined as normal at step 305. Then, at step 306, a lock control is performed so as to lock the VCT phase into the middle lock phase. The other matters in the second embodiment are similar to those of the first embodiment.

Third Embodiment

In the first embodiment, when the OCV 25 cannot recover from the oil filling mode by abnormality, a flow rate of oil pumped by the oil pump 28 is controlled to become equal to or higher than a predetermined value.

Figure 9:
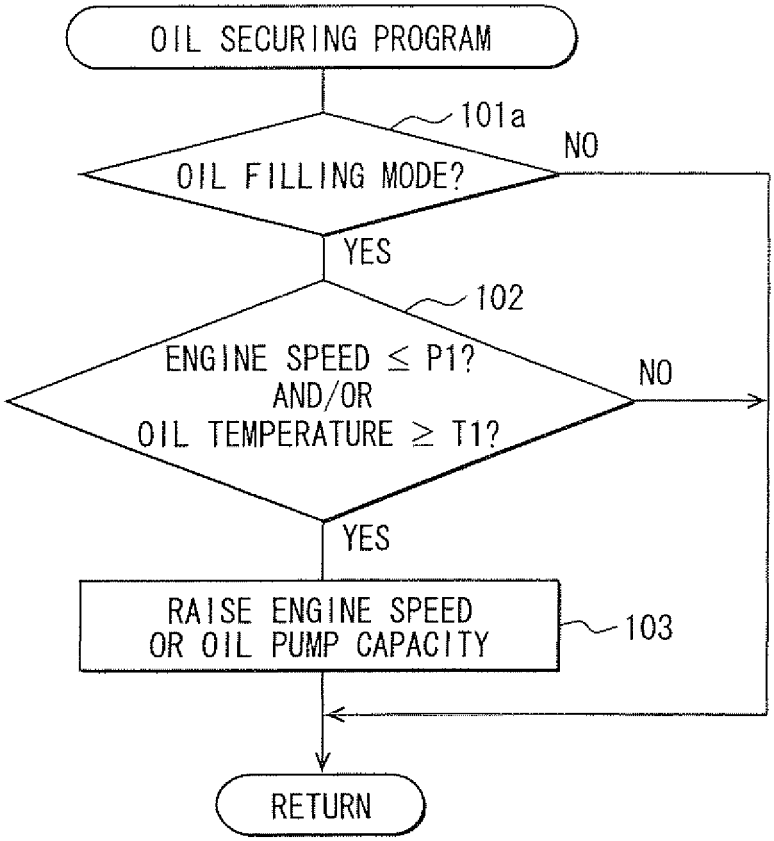
FIG. 9 is a flow chart illustrating an oil securing program according to a third embodiment.

In a third embodiment, when the OCV 25 has an oil filling mode, an oil securing program of FIG. 9 is performed. Thus, a flow rate of oil pumped by the oil pump 28 is controlled to become equal to or higher than a predetermined value that secures oil amount for lubricating the engine 11 only when the OCV 25 has an oil filling mode.

In the variable valve timing device 18 having the middle lock mechanism 50, the VCT phase is locked at the middle lock phase while the engine is stopped. After the engine is activated, oil is required to be quickly filled into both of the advance chamber 42 and the retard chamber 43. However, if the OCV 25 is set to have the oil filling mode when the engine is started, a part of oil supplied to the retard chamber 43 may be directly discharged into the drain side. In this case, oil is consumed in vain, so that oil lubricating the engine 11 may be shorted.

At step 101*a* of FIG. 9, it is determined whether the OCV 25 has the oil filling mode. When the OCV 25 does not have the oil filling mode, the program of FIG. 9 is ended without any action.

If it is determined that the OCV 25 has the oil filling mode at step 101*a*, step 102 is performed. At step 102, it is determined whether the engine speed is equal to or slower than a predetermined value P1 and/or whether the temperature of oil is equal to or higher than a predetermined value T1. If step 102 is determined as No, the program of FIG. 9 is ended without performing the oil securing control because the lubricating oil amount is determined as enough.

If step 102 is determined as Yes, step 103 is performed because the lubricating oil amount is determined as insufficient. At step 103, a speed of the engine that drives the pump 28 is raised so as to secure the lubricating oil amount. Alternatively, the capacity of the pump 28 is raised so as to secure the lubricating oil amount, when the oil pump 28 has a variable capacity.

Step 102 may be omitted. That is, when the OCV 25 continues to have the oil filling mode, the engine speed or the capacity of the pump 28 is raised at step 103 regardless of the engine speed or the oil temperature.

According to the third embodiment, when the OCV 25 has the oil filling mode, the oil securing control is performed. That is, the amount of oil discharged from the pump 28 is controlled in a manner that a predetermined amount of oil for lubricating the engine 11 is secured while oil is filled into the advance chamber 42 and the retard chamber 43. Thus, lubricating property of the engine 11 can be maintained better while oil is filled into the chambers 42, 43.

Alternatively, the oil securing control may be performed intermittently when the OCV 25 has the oil filling mode. Specifically, the oil securing control may be switched to be performed or stopped alternately by a predetermined duration. In such a case, the lubricating property of the engine 11 can be secured even when the OCV 25 has the oil filling mode because the amount of oil for lubricating the engine 11 can be intermittently increased.

Other Embodiment

The present invention is applied to a variable valve timing device for an intake valve. Alternatively, the present invention may be applied to a variable valve timing device for an exhaust valve. In this case, a relationship between "advance" and "retard" is made opposite from a relationship for the intake valve.

Constructions of the variable valve timing device 18 and the OCV 25 may be suitably modified.

Such changes and modifications are to be understood as being within the scope of the present invention as defined by the appended claims.

What is claimed is:

1. A variable valve timing control apparatus comprising:

a variable valve timing device that controls valve timing by changing a rotation phase of a camshaft with respect to a crankshaft in an engine, the rotation phase of the camshaft with respect to the crankshaft being defined as a VCT phase;

a lock pin to lock the VCT phase at a middle lock phase positioned at a middle in a controllable range of the VCT phase;

an oil pressure control valve to control pressure of oil supplied to an advance chamber that drives the VCT phase into an advance side, a retard chamber that drives the VCT phase into a retard side, and a lock chamber that drives the lock pin;

an oil pump to supply oil to the oil pressure control valve; and an oil securing portion to execute an oil securing control, wherein the variable valve timing device is configured to make the advance chamber and the retard chamber to communicate with each other by controlling the oil pressure control valve in a manner that the VCT phase is locked at the middle lock phase by projecting the lock pin, the oil pressure control valve supplies oil to one of the advance chamber and the retard chamber that communicate with each other when the oil pressure control valve has an oil filling mode in which both of the advance chamber and the retard chamber are filled with oil, the oil securing portion executes the oil securing control in which the oil pump is controlled to have an oil flow rate that is equal to or larger than a predetermined value when the oil pressure control valve has the oil filling mode, the oil securing portion determines whether or not to execute the oil securing control based on at least one of a rotation speed of the engine and a temperature of the oil, and the oil pump is driven by only the engine.

2. The variable valve timing control apparatus according to claim 1, wherein the oil securing portion executes the oil securing control when the oil pressure control valve is unable to recover from the oil filling mode by abnormality.

3. The variable valve timing control apparatus according to claim 2, wherein the oil pressure control valve is unable to recover from the oil filling mode, when the oil pressure control valve is sticking to the oil filling mode.

4. The variable valve timing control apparatus according to claim 2, wherein the oil pressure control valve is unable to recover from the oil filling mode, when a signal that drives the oil pressure control valve is fixed to the oil filling mode.

5. The variable valve timing control apparatus according to claim 2, wherein the oil pressure control valve is configured to have the oil filling mode when electricity is not supplied to the oil pressure control valve, and the oil pressure control is unable to recover from the oil filling mode, when the electricity supply to the oil pressure control valve is impossible.

6. The variable valve timing control apparatus according to claim 2, wherein the oil securing portion temporarily unlocks the VCT phase every time when the lock of the VCT phase at the middle lock phase is continued for a predetermined duration, and the oil pressure control valve is unable to recover from the oil filling mode, when the unlocking of the VCT phase is impossible.

7. The variable valve timing control apparatus according to claim 1, wherein the oil securing portion raises a rotation speed of the engine that drives the oil pump while the oil securing control is performed.

8. The variable valve timing control apparatus according to claim 1, wherein the oil pump has a variable capacity, and the oil securing portion raises the variable capacity of the oil pump while the oil securing program is performed.

9. The variable valve timing control apparatus according to claim 1, wherein the oil securing portion determines to execute the oil securing control when the rotation speed of the engine is lower than or equal to a predetermined speed, and the oil securing portion determines not to execute the oil securing control when the rotation speed of the engine is higher than the predetermined speed.

10. The variable valve timing control apparatus according to claim 1, wherein the oil securing portion determines to execute the oil securing control when the temperature of the oil is higher than or equal to a predetermined temperature, and the oil securing portion determines not to execute the oil securing control when the temperature of the oil is lower than the predetermined temperature.

11. The variable valve timing control apparatus according to claim 1, wherein the oil securing portion limits an execution range of the oil securing control based on at least one of the rotation speed of the engine and the temperature of the oil.

12. A variable valve timing control apparatus comprising:

a variable valve timing device that controls valve timing by changing a rotation phase of a camshaft with respect to a crankshaft in an engine, the rotation phase of the camshaft with respect to the crankshaft being defined as a VCT phase;

a lock pin to lock the VCT phase at a middle lock phase positioned at a middle in a controllable range of the VCT phase;

an oil pressure control valve to control pressure of oil supplied to an advance chamber that drives the VCT phase into an advance side, a retard chamber that drives the VCT phase into a retard side, and a lock chamber that drives the lock pin;

an oil pump to supply oil to the oil pressure control valve; and an oil securing portion to execute an oil securing control, wherein the variable valve timing device is configured to make the advance chamber and the retard chamber to communicate with each other by controlling the oil pressure control valve in a manner that the VCT phase is locked at the middle lock phase by projecting the lock pin, the oil pressure control valve supplies oil to one of the advance chamber and the retard chamber that communicate with each other when the oil pressure control valve has an oil filling mode in which both of the advance chamber and the retard chamber are filled with oil, the oil securing portion executes the oil securing control in which the oil pump is controlled to have an oil flow rate that is equal to or larger than a predetermined value when the oil pressure control valve has the oil filling mode, the oil securing portion executes the oil securing control when the oil pressure control valve is unable to recover from the oil filling mode by abnormality, the oil pressure control valve is configured to have the oil filling mode when electricity is not supplied to the oil pressure control valve, and the oil pressure control is unable to recover from the oil filling mode, when the electricity supply to the oil pressure control valve is impossible.

* * * * *